United States Patent [19]

Hewlett

[11] 4,249,663

[45] Feb. 10, 1981

[54] CONVERTIBLE LOADING AND SHIPPING POUCH AND MOUNTING MEANS FOR AUTOMATED PHOTOGRAPHIC CUSTOMER ORDER SORTING DEVICE

[75] Inventor: Malcolm L. Hewlett, Bellingham, Wash.

[73] Assignee: CX Corporation, Seattle, Wash.

[21] Appl. No.: 23,244

[22] Filed: Mar. 23, 1979

[51] Int. Cl.[3] ..... B07C 7/04; B65B 67/04

[52] U.S. Cl. ..... 209/705; 209/933; 209/698; 150/3; 211/12; 211/84; 248/99

[58] Field of Search ..... 209/705, 698, 933; 150/3; 211/12, 84; 248/95, 97, 99–101; 53/570, 459, 244

[56] References Cited

U.S. PATENT DOCUMENTS

| | | | |
|---|---|---|---|
| 365,386 | 6/1887 | Kirk | 211/12 |
| 2,377,619 | 6/1945 | Ernst | 209/933 X |
| 2,527,746 | 10/1950 | Lawrence | 150/3 X |
| 3,138,361 | 6/1964 | Meldrum | 248/95 |
| 3,517,808 | 6/1970 | Lauer | 209/933 X |
| 3,759,381 | 9/1973 | Mercadie | 209/933 X |

*Primary Examiner*—Allen N. Knowles

*Attorney, Agent, or Firm*—Christensen, O'Connor, Johnson & Kindness

[57] ABSTRACT

Intended primarily for use in the commercial photofinishing industry, a convertible loading and delivery pouch together with associated mounting means in an automatic sorter device is disclosed. A number of such pouches demountably installed at successive loading stations along the sorter conveyor path are maintained suspended from parallel support arms in normally open, article receiving position with the front walls of the individual pouches bowed outwardly to accommodate the articles being discharged from the conveyor at such stations. With the pouches removed from the support arms, the front walls can be bowed inwardly against the sidewalls and rear wall in order to permit interengaging the cooperating elements of a closure device such as a slide fastener to secure the contents within the pouch for delivery purposes. Mounting loops formed along the upper edge portions of the sidewalls and open rearwardly of the pouch are adapted to slidably engage the support arms to permit convenient installation and removal of the pouch and to maintain the pouch walls securely in the open position when mounted in the automatic sorter.

13 Claims, 4 Drawing Figures

48
36
34
40
42
32
44
38
46
30
28
26
16
20
8
18
13
50
19
15
12
17
14
11
10

CONVERTIBLE LOADING AND SHIPPING POUCH AND MOUNTING MEANS FOR AUTOMATED PHOTOGRAPHIC CUSTOMER ORDER SORTING DEVICE

BACKGROUND OF THE INVENTION

This invention relates to pouches adapted to receive and hold envelopes and similar items and more particularly relates to a convertible loading and unloading pouch and means for mounting the pouch on an automated photographic customer order sorting device.

In the photofinishing industry, orders from individual customers are received at a dealer location and then shipped from the dealer locations to a central processing laboratory. After processing is completed, it is necessary to sort the envelopes containing individual orders from the multitude of orders that have been subjected to the large scale batch processing operation in order to return the finished order to the individual customer.

In the past, most of the sorting has been conducted manually. Due to the increasingly competitive nature of the business and the resultant need for reducing labor costs and increasing the output volume capacity of a facility, it has become desirable to automate the sorting process. In connection with automated sorting, and in order to take maximum advantage of the time and labor savings realized, it is also desirable to minimize subsequent handling of the product. To that end and also to avoid human errors that can arise through unnecessary handling, the present invention provides a novel convertible loading and shipping pouch for each dealer/-customer into which the envelopes containing the finished orders for that dealer can be delivered in the automatic sorting machine and which lends itself when closed to serve also as a practical delivery container.

An efficient automatic sorting machine has been developed which carries the envelopes to the sorting locations in a vertical orientation in preformed pockets that have a hinged bottom panel which can be controllably opened to deliver the envelopes to the proper sorting receptacle. The bags presently used in the photo industry for delivering orders to dealers are not suitable for direct mounting on the sorting apparatus of the type described. The bags cannot easily be mounted on such a sorting apparatus while being oriented to provide an opening suitable for the reception of envelopes from the sorter. It is therefore a more specific object of the present invention to provide a convertible loading and shipping pouch that is quickly and readily mountable and demountable in such an automatic sorting apparatus.

It is another object of this invention to provide a machine-loadable, durable and yet readily handled convertible loading and shipping pouch of flexible material, together with associated mounting means by which to suspend the pouch removably at a loading station in an automated sorter, such that, despite flexibility of the pouch wall material, the pouch will remain consistently open to receive the customer order envelopes discharged into it from the sorting device conveyor, the pouch then being easily removable from the sorting device and its top closed and secured closed by convenient fastener means for subsequent handling and delivery to the dealer.

It is another object of this invention to provide such a pouch that is relatively lightweight, easily and safely storable and relatively inexpensive to manufacture.

BRIEF SUMMARY OF THE INVENTION

As disclosed, the pouch includes opposite sidewalls interconnected by a rear wall. The sidewalls have mounting means on their upper edge portions adapted to demountably engage external support arms. The support arms maintain the sidewall upper edge portions at a predetermined spacing at the front of the pouch. The pouch also includes a front wall of a width greater than the predetermined spacing between the front upper edges of the sidewalls. The front wall is made of a stiffly flexible material and, when mounted in the pouch open set configuration, maintains an outwardly bowed configuration. When the pouch is demounted from the support arms the front wall is adapted to be bowed inwardly against the rear wall and sidewalls in order to close the top of the pouch for handling and shipment. Cooperating closure elements, such as slide fastener elements, on the upper edge portions of the front wall and on the sidewalls and rear wall are interengageable to secure the pouch closed.

BRIEF DESCRIPTION OF THE DRAWINGS

Further objects, features and advantages of the invention will be more apparent from the ensuing specification in conjunction with the attached drawings wherein.

DETAILED DESCRIPTION OF THE PREFERRED EMBODIMENT

Figure 1:
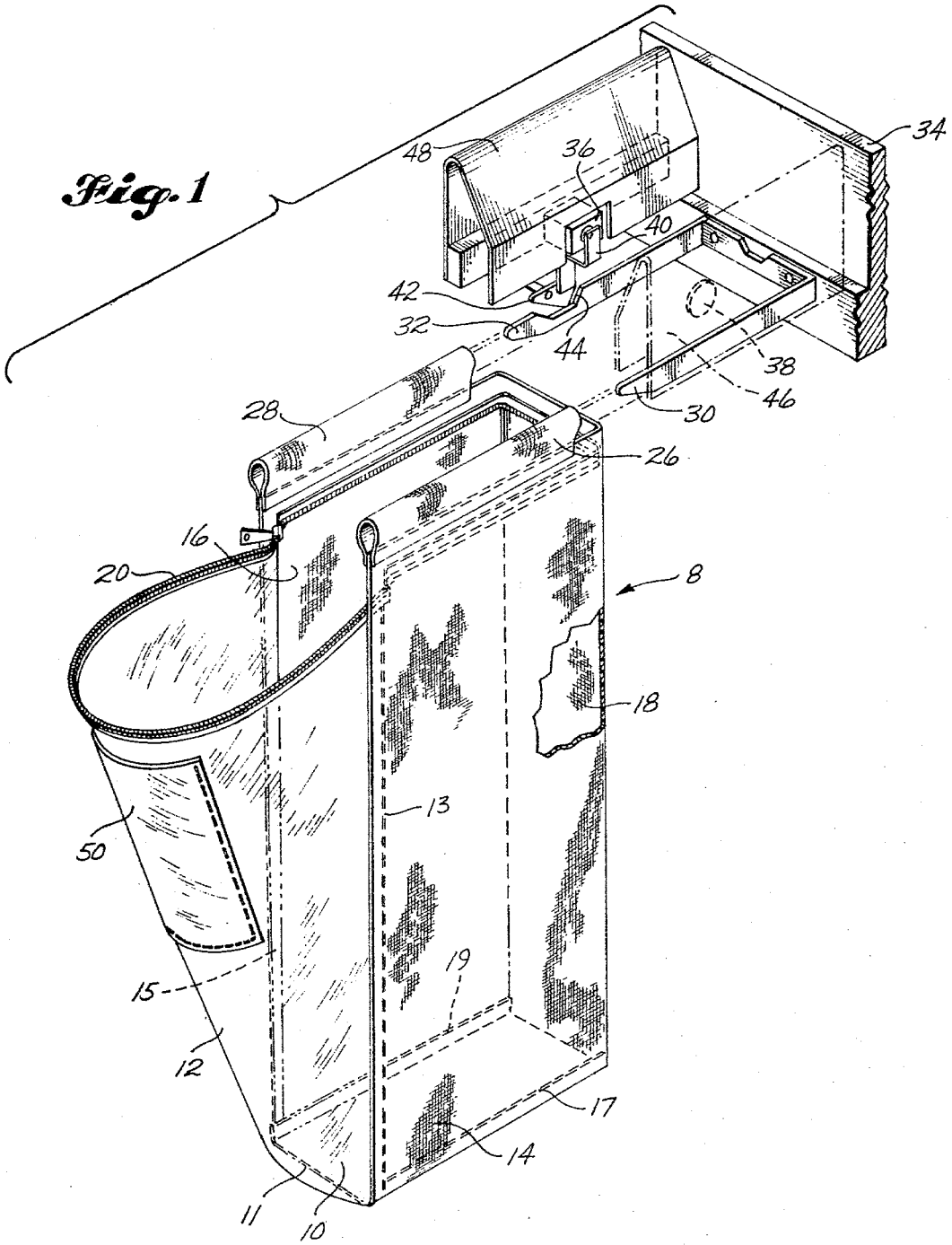
FIG. 1 is a perspective view of one embodiment of a convertible loading and delivery pouch and mounting means therefor made in accordance with the principles of the present invention.
Figure 2:
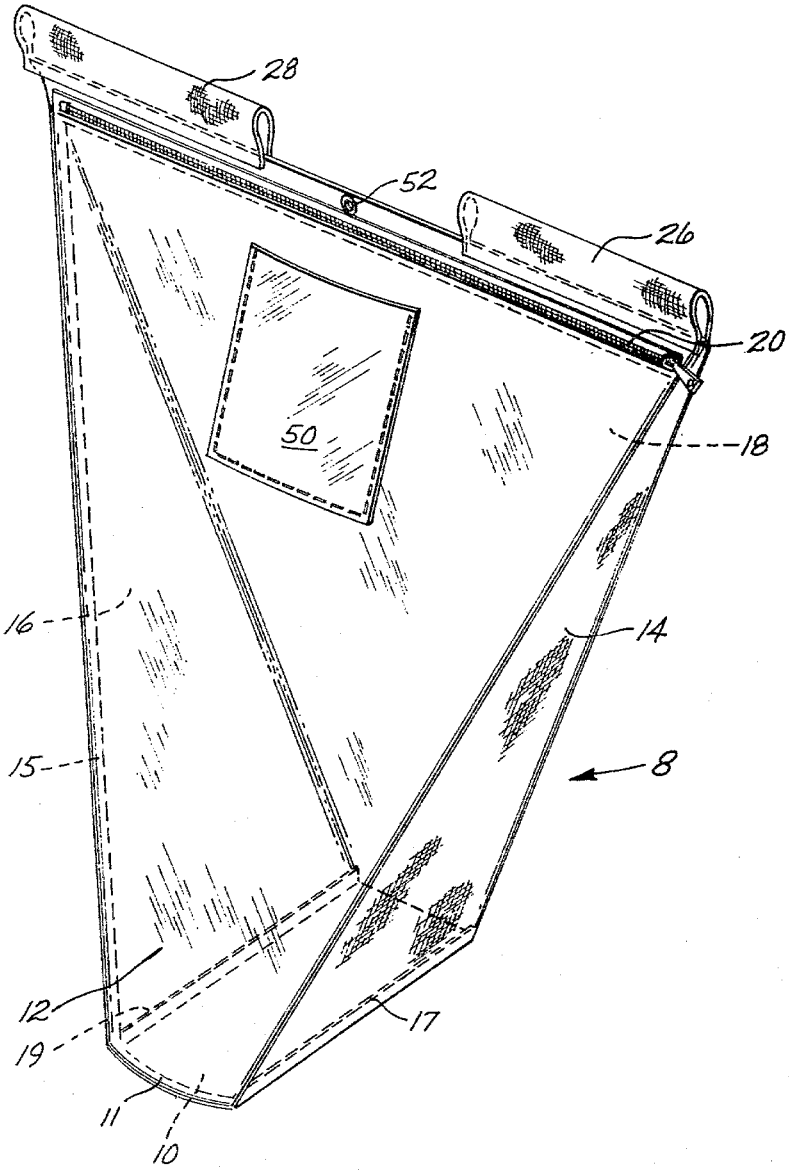
FIG. 2 is a perspective view of the convertible pouch of FIG. 1 removed from the sorting device and ready for shipment.
Figure 3:
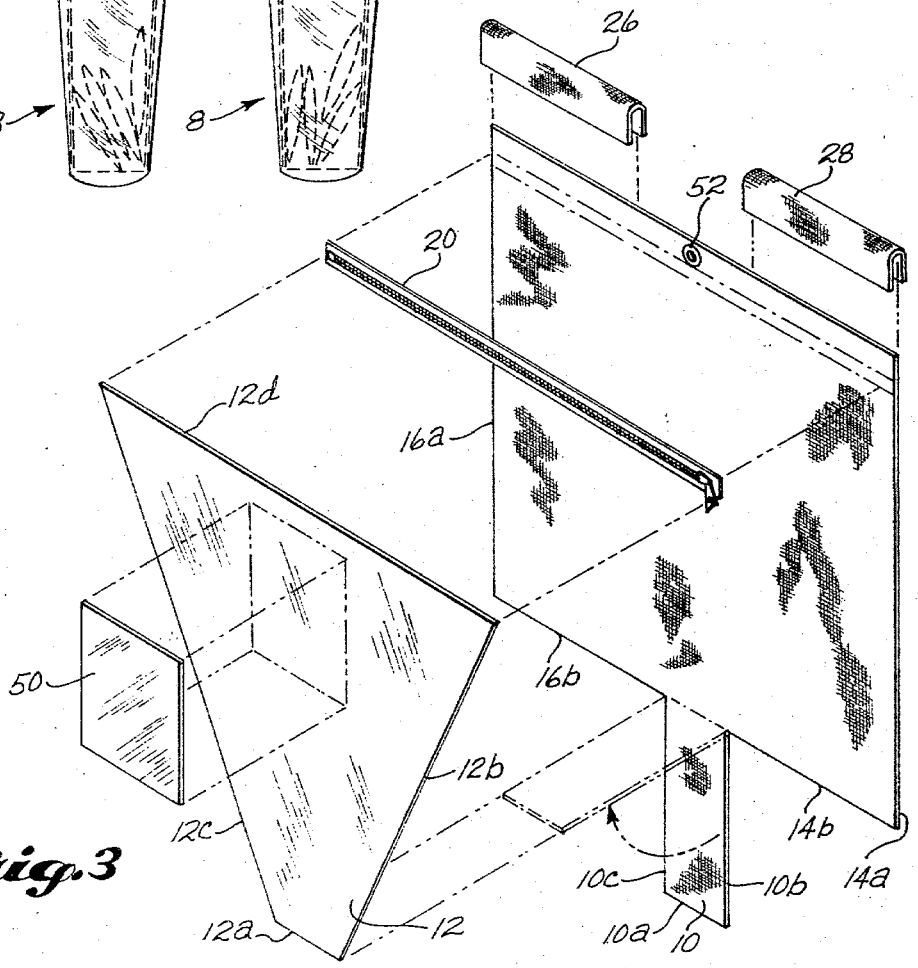
FIG. 3 is an exploded view of the parts of the convertible pouch of FIGS. 1 and 2 prior to final construction.

Referring now to FIGS. 1, 2 and 3, the convertible pouch or receptacle 8 adapted for use in the photofinishing business is made of stiffly flexible materials, such as fabric or plastic sheets, and is configured to maintain two basic configurations, one with its top open when mounted in a sorting device in position to be loaded with customer order envelopes, and the other with the pouch removed from the device and its top closed for handling and delivery to the customer. The pouch 8 preferably has a rectangular bottom panel 10. A preferably transparent front wall 12 of substantially trapezoidal shape, diverging upwardly, is affixed along a lower edge 12*a* to the forward edge 10*a* of the bottom panel 10 by a seam 11. The edge 10*a* is one of the short sides of the bottom panel rectangle. Side edges 12*b* and 12*c* respectively of the front wall 12 are adjacent and attached to side edges 14*a* and 16*a*, respectively, of the sidewalls 14 and 16 by seams 13 and 15. Bottom edges 14*b* and 16*b* of the sidewall 14 and 16 respectively, are affixed to the side edges 10*b* and 10*c* of the botom panel 10 by seams 17 and 19, respectively. The container portion of the pouch 8 is completed by rear wall 18, attached at a lower edge to the rear edge of the bottom panel and attached at its side edges to the rear side edges of the sidewalls 14 and 16, respectively. In the illustrated embodiment, the bottom panel 10, sidewalls 14 and 16 and rear wall 18 are formed from a single piece of fabric. Preferably, each of the seams 11, 13 and 15 are joined together by a folded welt strip which runs along each of the seams and is stitched together with the seam to provide a sturdy construction.

As best seen in FIG. 2, the sidewalls 14 and 16 and rear wall 18 extend upwardly a distance slightly greater than the front wall 12. The top edges of the sidewalls and rear wall are folded over and stitched to form a double wall at the top of the rear wall and sidewalls of the pouch. Slide fastener 20 is affixed to the top edge **12*d* of the front wall 12 and also is stitched along the sidewalls 14 and 16 and rear wall 18 adjacent the top edge of the front wall so that in its unmounted configuration, the top of the pouch can be closed by the slide fastener 20** to retain the contents during shipment of the pouch to the customer.

Figure 4:
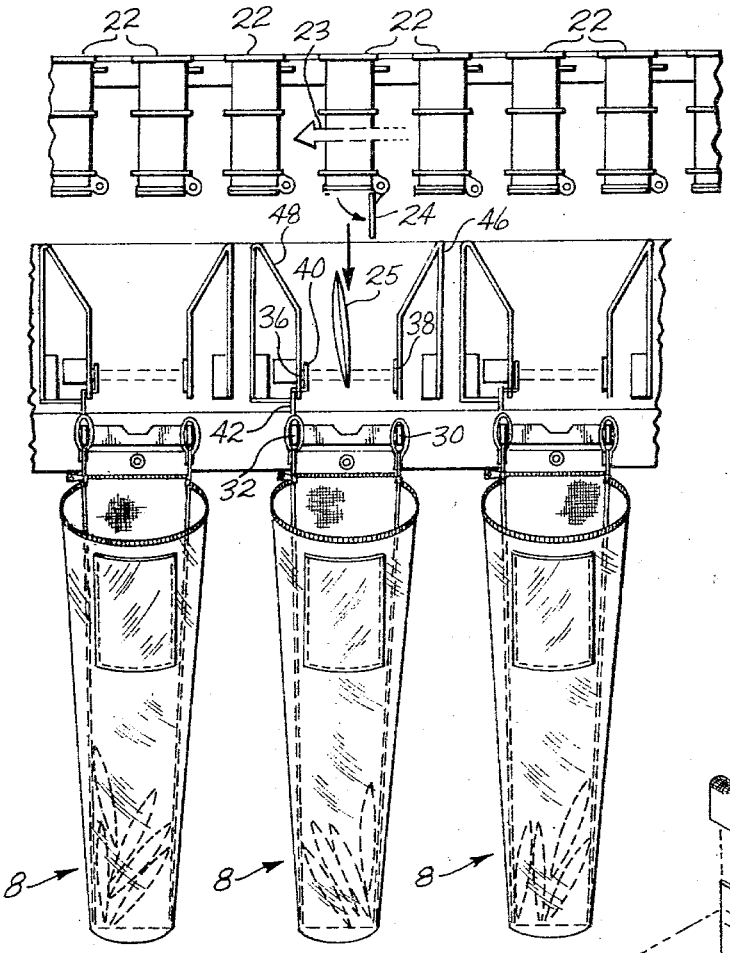
FIG. 4 is a front elevational view of a convertible pouch and mounting means made in accordance with the principles of the present invention in combination with a sorting device.

A portion of a sorting device of the type with which the convertible pouch of the present invention is most advantageously used is shown somewhat schematically in FIG. 4. The sorting device has a series of pockets 22 which move in a continuous path as shown by arrow 23, each of the pockets having a hinged bottom panel 24 which is opened at the desired locations by a controller (not shown) to empty the contents of the pocket 22 through the opening created by the movement of the hinged bottom panel 24. The item to be sorted, in this case an envelope 25 containing a photofinishing order, falls through the bottom opening into the mounted pouch 8. The details of mounting the pouch 8 on the sorting machine are best seen in FIG. 1. In the mounted configuration pictured, the sidewalls 14 and 16 and rear wall 18 form a substantially U-shape. In this configuration, the front wall 12 has a stable position in which it is bowed out to form an oppositely directed U-shape. The two opposed U-shaped bends create an elongate opening in the top of the pouch with the elongate dimension of the opening oriented substantially parallel to the long dimension of the rectangular bottom panel 10. The elongate dimension of the opening should be sufficient to accept easily the items that are being dropped from the sorting pockets.

With others mounted like it in series along the sorter, conveyor path, the pouch is mounted in the sorting device by a pair of rearwardly open mounting loops 26 and 28 formed of pieces of fabric or plastic, folded over and stitched to the upper edge of the sidewalls 14 and 16, respectively. The loops 26 and 28 slidably engage a pair of horizontally oriented support arms 30 and 32 affixed in parallel spaced relation to a frame member 34 of the sorting device and positioned below the bottoms of the pockets 22. The spacing of the support arms 30 and 32 must be such as to maintain the opening in the pouch at a width sufficient to allow the items falling from the moving pockets to enter the pouch without interference. The spacing of arms 30 and 32 is less than the width of the front wall 12 at the top, so as to maintain the front wall outwardly bowed and the pouch at maximum opening at its top when suspended by the support arms. Thus, one spacing of the sidewalls 14 and 16 is maintained at the top by the rigid support arms 30 and 32 and at the bottom by its attachment to the rectangular bottom panel 10. It is important that the front wall 12 be stable in its bowed-out position so that the opening in the top of the pouch is reliably maintained throughout the sorting process. The front wall while flexible must be constructed of a material of appreciable stiffness. A suitable material for the front wall has been found to be 12 gauge unsupported vinyl having a softness or handling factor of 2—S. Also a suitable material for the sidewalls, rear wall and bottom panel has been found to be 10 ounce nylon reinforced vinyl laminate. These materials are exemplary only and are not meant to limit the scope of the invention.

Preferably, the sidewalls, rear wall and bottom panel are constructed of a single piece of fabric cut to the proper shape. Also, the loops 26 and 28 are separate pieces folded over to form the loops and sewn onto the upper folded edge of the sidewalls 14 and 16. It would be possible to make the loops 26 and 28 an integral part of the sidewalls 14, 16 and rear wall 18 in the same way that the bottom panel 10 is an integral part of one piece of fabric. One advantage to having the loops separate pieces is that it is easier to then attach a folded welt strip to the edges of the loops to strengthen the loops to provide a sufficiently strong mount for the pouch when it is full. The front wall 12 preferably has a pocket 50 attached thereto. The pocket 50 can be utilized to hold a route slip or other destination indicator for use of the processing personnel in determining where the pouch and its contents are to be shipped. Further, an eyelet 52 is mounted in the top, central portion of the rear wall 18. The eyelet 52 provides a means for hanging the pouches on a hook or rod during shipment or storage.

In the illustrated sorter apparatus in which the pouch is used, a retro-sensor 36 is mounted by conventional means above the support arm 32. The retro-sensor generates a beam of light and transmits the beam across the top of the pouch to a reflector 38 mounted above the support arm 30. The reflector 38 reflects the light beam back to the retro-sensor 36 and causes the retro-sensor to send a signal to the sorter control unit (not shown). A shutter member 40 is hingedly mounted in association with the retro-sensor 36 such that an upwardly extending plate portion of the shutter member 40 covers the front of the retro-sensor 36, blocking the light beam path to the reflector 38. The shutter member 40 has a downwardly extending plate portion linked to a triangular cam member 42 mounted for pivotal movement in response to the placement of a pouch on the mounting arms 30, 32. In its initial position, the cam member 42 fits into a notch 44 formed in the mounting bar 32. When the cam member 42 is in the notch 44, the shutter member plate is in position blocking the light path from the retro-sensor 36. When a pouch is placed on the sorting device, the loop 28 engages the cam member 42 and moves it out of the notch 44 in turn causing the shutter member plate to move out of the light path allowing completion of the reflective path between the retro-sensor 36 and the reflector 38 thereby enabling the retro-sensor to send a signal to the controller indicating that a pouch is in place on the sorting machine. Envelope deflectors 46 and 48 are mounted intermediate the pockets 22 and the support arms 30, 32 in flanking relationship to the path of the envelopes 25 as they drop from the pockets 22 to the pouches below. The deflectors 46 and 48 have inwardly and downwardly sloping plate portions to assist the envelopes to enter the opening in the top of the pouch.

While the receptacle of the present invention is illustrated and described in the environment of a photofinishing laboratory and is described as receiving envelopes containing photofinishing orders, it will be understood by those skilled in the art and others that the receptacle of the present invention is utilizable in many varied environments in which envelopes or similarly shaped items are to be sorted and subsequently delivered to locations remote from the sorting facility.

Although one embodiment of a convertible loading and delivery pouch and mounting means therefor has been illustrated and described it will be seen by those of ordinary skill in the art and others that various modifications can be made to the receptacle illustrated and described above within the intended scope of the present invention as defined in the following claims.

The embodiments of the invention in which an exclusive property or privilege is claimed are defined as follows:

1. A convertible article loading and delivery pouch adapted to be removably mounted with its top open to receive articles at a loading station, said pouch comprising opposite sidewalls interconnected by a rear wall, said sidewalls having upper edge portions with mounting means thereon adapted to demountably engage external support arms for maintaining the sidewalls upper edge portions at a predetermined spacing at the front of the pouch, and a front wall of a width greater than said predetermined spacing interconnecting said sidewalls, said front wall being of stiffly flexible material tending to maintain an outwardly bowed configuration maintaining the pouch open at the top with the pouch thus suspended, said front wall being adapted to be bowed inwardly against the rear wall and sidewalls in order to close the top of the pouch with the pouch demounted from said support arms, and cooperating closure elements on the upper edge portions of the front wall and on said side and rear walls interengageable to secure the pouch closed with the front wall thus bowed inwardly.

2. The pouch defined in claim 1 including a bottom panel interconnecting the side, front and rear walls of the pouch and having substantially rectangular configuration with a width between said sidewalls at least approximating said predetermined spacing.

3. The pouch defined in claim 1 wherein the mounting means on the upper edge portions of the sidewalls comprise loop means opening to the rear of the pouch extending lengthwise of said sidewalls upper edge portions, respectively.

4. The pouch defined in claims 1, 2 or 3 wherein the cooperating closure elements comprise slide fastener elements extending lengthwise of the upper edge portions of the front wall and across the rear wall and extending across the sidewalls, respectively.

5. The receptacle defined in claim 1 wherein the front wall comprises transparent synthetic plastic material.

6. An article loading apparatus comprising, in combination, means to deliver articles along a conveyance path that extends through a succession of loading stations and operable to discharge the conveyed articles selectively at any of the different loading stations, said apparatus including at each loading station a pair of support arms maintained in substantially horizontal spaced parallel relationship to permit passage of individual articles between them upon discharge at such loading stations, and a plurality of convertible article loading and delivery pouches adapted to be demountably suspended on the respective pairs of support arms at such loading stations with the tops of such pouches maintained open to receive the articles, each said pouch comprising opposite sidewalls interconnected by a rear wall, said sidewalls having upper edge portions with mounting means thereon adapted to demountably engage the support arms of a pair for maintaining the sidewalls upper edge portions at predetermined spacing at the front of the pouch, and a front wall of a width greater than said predetermined spacing interconnecting said sidewalls, said front wall being of stiffly flexible material tending to maintain an outwardly bowed configuration maintaining the pouch open at the top with the pouch thus suspended, said front wall being adapted to be bowed inwardly against the rear wall and sidewalls in order to close the top of the pouch with the pouch demounted from said support arms, and cooperating closure elements on the upper edge portions of the front wall and on said side and rear walls interengageable to secure the pouch closed with the front wall thus bowed inwardly.

7. The combination defined in claim 6 including a bottom panel interconnecting the side, front and rear walls of the pouch and having substantially rectangular configuration with a width between said sidewalls at least approximating said predetermined spacing.

8. The combination defined in claim 6 wherein the mounting means on the upper edge portions of the sidewalls comprise loop means opening to the rear of the pouch extending lengthwise of said sidewalls upper edge portions, respectively.

9. The combination defined in claims 6, 7 or 8 wherein the cooperating closure elements comprise slide fastener elements extending across the front wall lengthwise of the upper edge portions thereof and across the rear wall and extending across the sidewalls, respectively.

10. An apparatus for use in photofinishing operations wherein individual customer photograph orders are packaged in separate delivery envelopes, automatic customer order sorting apparatus comprising, in combination, means to deliver articles along a conveyance path that extends through a succession of loading stations and operable to discharge the articles selectively at any of the different loading stations, said apparatus including at each loading station a pair of support arms maintained in substantially horizontal spaced relationship to permit passage of the customer envelopes between them upon discharge at such loading stations, and a plurality of convertible customer envelopes loading and delivery pouches adapted to be demountably suspended on the respective pairs of support arms at such loading stations with the tops of such pouches maintained open to receive the customer envelopes, each said pouch comprising opposite sidewalls interconnected by a rear wall, said sidewalls having upper edge portions with mounting means thereon adapted to demountably engage the support arms of a pair for maintaining the sidewalls upper edges portions at predetermined spacing at the front of the pouch, and a front wall of a width greater than said predetermined spacing interconnecting said sidewalls, said front wall being of stiffly flexible material tending to maintain an outwardly bowed configuration maintaining the pouch open at the top with the pouch thus suspended, said front wall being adapted to be bowed inwardly against the rear wall and sidewalls in order to close the top of the pouch with the pouch demounted fron said support arms, and cooperating closure elements on the upper edge portions of the front wall and on said side and rear walls interengageable to secure the pouch closed with the front wall thus bowed inwardly.

11. The apparatus defined in claim 10 further comprising a bottom panel interconnecting the side, front and rear walls of the pouch and having a substantially rectangular configuration with a width between said sidewalls at least approximating said predetermined spacing.

12. The apparatus defined in claim 10 wherein the mounting means on the upper edge portions of the sidewalls comprise loop means opening to the rear of the pouch extending lengthwise of said sidewalls upper edge portions, respectively.

13. The apparatus defined in claims 10, 11 or 12 wherein the cooperating closure elements comprise slide fastener elements extending lengthwise of the upper edge portions of the front wall and across the rear wall and extending across the sidewalls, respectively.

* * * * *